US007246680B2

(12) United States Patent
Osterkamp et al.

(10) Patent No.: US 7,246,680 B2
(45) Date of Patent: Jul. 24, 2007

(54) SOUND DAMPENING ASSEMBLY FOR AUTOMOTIVE EXHAUST SYSTEM

(75) Inventors: Dale F. Osterkamp, Novi, MI (US); Andrew J Kurzawa, Romeo, MI (US)

(73) Assignee: General Motors Corporation, Detroit, MI (US)

( * ) Notice: Subject to any disclaimer, the term of this patent is extended or adjusted under 35 U.S.C. 154(b) by 405 days.

(21) Appl. No.: 10/883,168

(22) Filed: Jul. 1, 2004

(65) Prior Publication Data

US 2006/0000667 A1 Jan. 5, 2006

(51) Int. Cl.
*H05K 5/00* (2006.01)

(52) U.S. Cl. ..... 181/250; 181/273; 180/296

(58) Field of Classification Search ..... 181/250, 181/249, 240, 266, 273, 276; 123/184.57; 180/89.2, 296, 309
See application file for complete search history.

(56) References Cited

U.S. PATENT DOCUMENTS 3,505,028 A * 4/1970 Douthit ..... 428/652
4,408,675 A * 10/1983 Keller ..... 180/296
4,779,415 A * 10/1988 Richardson et al. ..... 60/313
5,283,398 A * 2/1994 Kotera et al. ..... 181/224

* cited by examiner

*Primary Examiner*—Brian Sircus
*Assistant Examiner*—Terrence R. Willoughby

(57) ABSTRACT

A sound dampening assembly adapted to engage an exhaust pipe in an automotive engine exhaust system adjacent an outlet of an internal combustion engine. The assembly includes a bottle portion having a single opening and an interior defining a predetermined amount of volume and a neck portion having a first end attached to the opening of the bottle portion and extending from the bottle portion. The neck portion is in fluid communication with the bottle portion interior and includes a second end adapted to be attached to the exhaust pipe. The neck portion has an interior defining a predetermined amount of volume and the bottle portion and the neck portion are sized to attenuate vibration at a predetermined frequency in the exhaust system.

3 Claims, 2 Drawing Sheets

SOUND DAMPENING ASSEMBLY FOR AUTOMOTIVE EXHAUST SYSTEM

BACKGROUND OF THE INVENTION

The present invention relates generally to automotive exhaust systems and, in particular, to a sound dampening assembly for an automotive exhaust system.

Automotive exhaust systems include piping and other components that treat an exhaust gas stream as well as rout the stream from an inlet connected to an internal combustion engine to an outlet to atmosphere.

Mufflers are disposed in the exhaust systems and are intended to smooth the exhaust gas pulsations and make the noise emitting from the tail pipe as inaudible as possible. To dampen and smooth the exhaust gas pulsations, mufflers and/or resonators use a combination of reflection and absorption techniques typically employing such traditional elements as helmholtz resonators, pipes perforated with holes and venturi nozzles. These traditional elements are sized and dimensioned (i.e. tuned) to have specified natural frequencies. These tuning elements, then, will dampen the frequencies of interest within the exhaust gas stream. Often, however, additional or unexpected noises occur in the exhaust system. These noises must also be dampened to minimize noises felt or heard in the passenger compartment and to assure compliance with noise regulations. Moreover, packaging concerns remain an issue in the design of the exhaust system because these traditional tuning elements consume a relatively large amount of space in the vehicle, which space in the vehicle and in the engine compartment in particular is limited.

It is desirable, therefore, to provide an effective sound dampening assembly for an automotive exhaust system that may be packaged easily within the engine compartment.

SUMMARY OF THE INVENTION

The present invention concerns a sound dampening assembly adapted to engage an exhaust pipe in an automotive engine exhaust system adjacent an outlet of an internal combustion engine. The assembly includes a bottle portion having a single opening and an interior defining a predetermined amount of volume and a neck portion having a first end attached to the opening of the bottle portion and extending from the bottle portion. The neck portion is in fluid communication with the bottle portion interior and includes a second end adapted to be attached to the exhaust pipe. The neck portion has an interior defining a predetermined amount of volume and the bottle portion and the neck portion are sized to attenuate vibration at a predetermined frequency in the exhaust system.

The frequency to be attenuated is found by testing of the exhaust system. Once the frequency to be attenuated has been determined, a location of the pressure antinode of the objectionable frequency within the exhaust system is determined, after which the diameter of the exhaust gas piping and the temperature of the exhaust gas at the location are measured. The dampening assembly is then designed to attenuate the objectionable frequency. The design of the sound dampening assembly and its effectiveness is a function of numerous variables including the measured frequency to be attenuated, the diameter of the exhaust gas piping, the measured exhaust gas temperature and the desired amount of attenuation. A wide variety of assumptions, simplifications and techniques can be used to design this sound dampening assembly. For example, a simple lumped element model may be used to determine the volume of the bottle portion of the dampening assembly by solving the following equation for $V_0$:

$$\omega = c\left[\frac{\pi a^2}{(L+2\alpha)V_0}\right]^{1/2} \quad \text{(Equation 1)}$$

In Equation 1, $V_0$ is the interior volume of the bottle portion, which has a neck portion consisting of a tube of radius a and a length L, c is the speed of sound, ω is the objectionable angular frequency, and alpha, α, is an end correction factor required to determine the effective length of the neck which is longer than the physical length because of its radiation-mass loading. The definition of the variables ω, α, a, L, and c, as just disclosed will have the same meaning throughout this specification. As will be appreciated by those skilled in the art, other mathematical formulations may be utilized to determine the volume of the sound dampening assembly while remaining within the scope of the present invention.

The sound dampening assembly in accordance with the present invention is a side branch tuning element that consists of a rigid-walled bottle portion that encloses a volume of exhaust gas with a small opening, or neck portion, used as a coupling between the gas in the bottle portion and the exhaust pipe. Preferably, the sound dampening assembly is adapted to attenuate vibration at the predetermined frequency in an exhaust Y-pipe prior to the sound reaching the traditional tuning elements contained in the exhaust system. The sound dampening assembly according to the present invention is located at the beginning, or front, of the exhaust system and dampens exhaust gas pulsations significantly earlier than traditional tuning elements. By attenuating or dampening the exhaust gases earlier in the exhaust system, the sound dampening assembly reduces the overall structure borne, pipe radiated and tail pipe noise content of the exhaust system. The design of the sound dampening assembly does not require the exhaust gases to flow through the tuning element, which is required in traditional tuning elements. By not requiring the exhaust gases to flow through the tuning element, the sound dampening assembly is packaged more easily and may, advantageously, be packaged in the underhood engine compartment, providing significant flexibility in its design, orientation and location.

The sound dampening assembly is particularly useful to provide the targeted noise performance when other techniques such as true dual exhaust systems, multiple mufflers and resonators or additional tuning volume are not available or adequate. The sound dampening assembly in accordance with the present invention provides a different approach to adding tuning elements to an exhaust system to meet specified noise targets or to eliminate specific exhaust related noise issues. The sound dampening assembly preferably attenuates the predetermined frequency to an acceptable level such that the noise and/or vibration at that frequency is no longer detectable.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
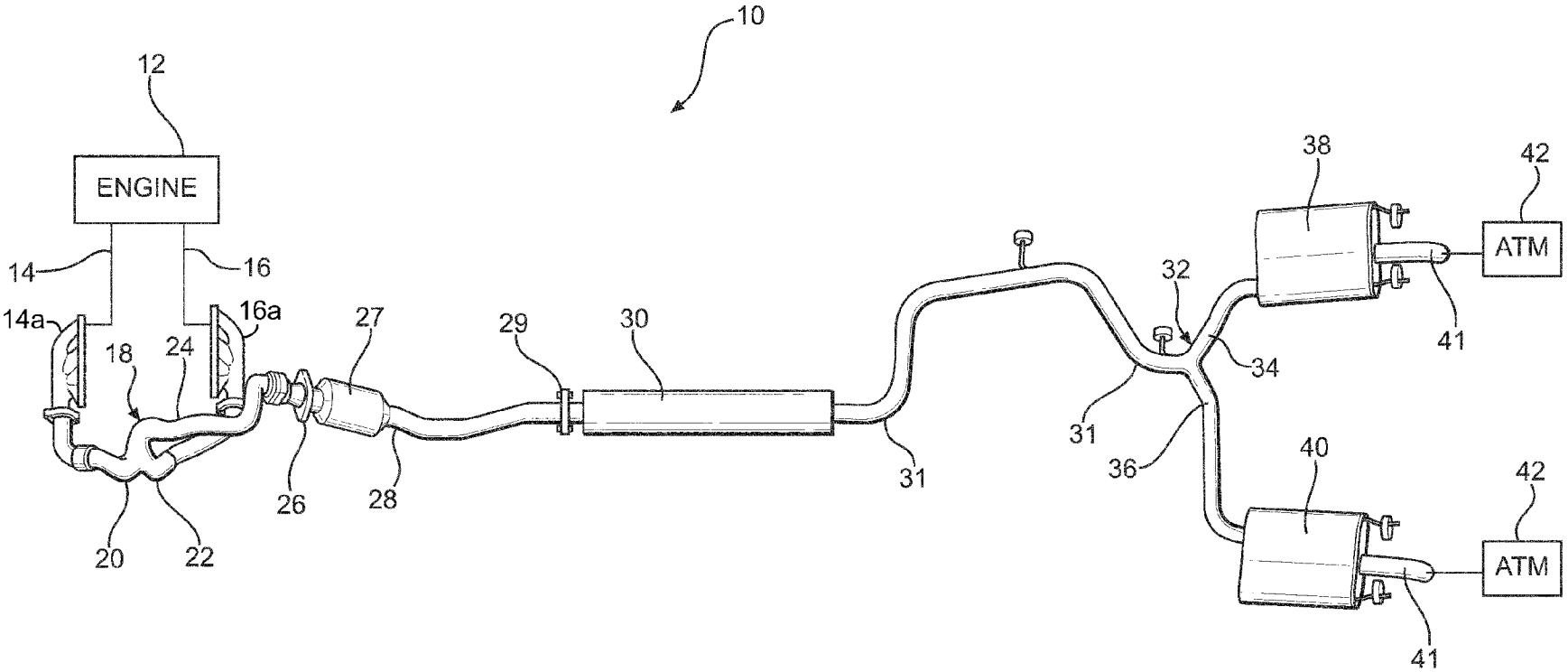
FIG - 1 PRIOR ART
FIG. 1 is a perspective view of a prior art automotive exhaust system.

Referring now to FIG. 1, a prior art exhaust system is indicated generally at 10. The exhaust system 10 is adapted to receive an exhaust gas stream from an engine, such as an internal combustion engine, indicated schematically at 12. A first outlet 14 and a second outlet 16 of the engine 12 are in fluid communication with a Y-pipe 18. The outlets 14 and 16 of the engine 12 may receive exhaust flow, for example, from two separate banks of cylinders (not shown) from the engine 12—in which case, the outlets 14 and 16 are constituted in part by a first exhaust manifold 14*a* and a second exhaust manifold 16*a*. respectively. The Y-pipe 18 includes a pair of inlets 20 and 22 for connection with the respective outlets 14 and 16 of the engine 12 and a single outlet 24. The outlet 24 of the Y-pipe 18 is in fluid communication with an inlet 26 of a catalytic converter assembly 27. An outlet 28 of the catalytic converter assembly is in fluid communication with an inlet 29 of the resonator 30. The outlet 31 of the resonator 30 is in fluid communication with a second Y-pipe 32. The second Y-pipe 32 includes an inlet for connection with the outlet 31 of the resonator and a pair of outlets 34 and 36. The outlet 34 of the second Y-pipe 32 is in fluid communication with an inlet of a first muffler 38 and the outlet 36 of the second Y-pipe 32 is in fluid communication with an inlet of a second muffler 40. A respective outlet of the first muffler 38 and the second muffler 40 is typically in fluid communication with a tail pipe 41, which opens to the atmosphere, indicated schematically at 42.

Figure 2:
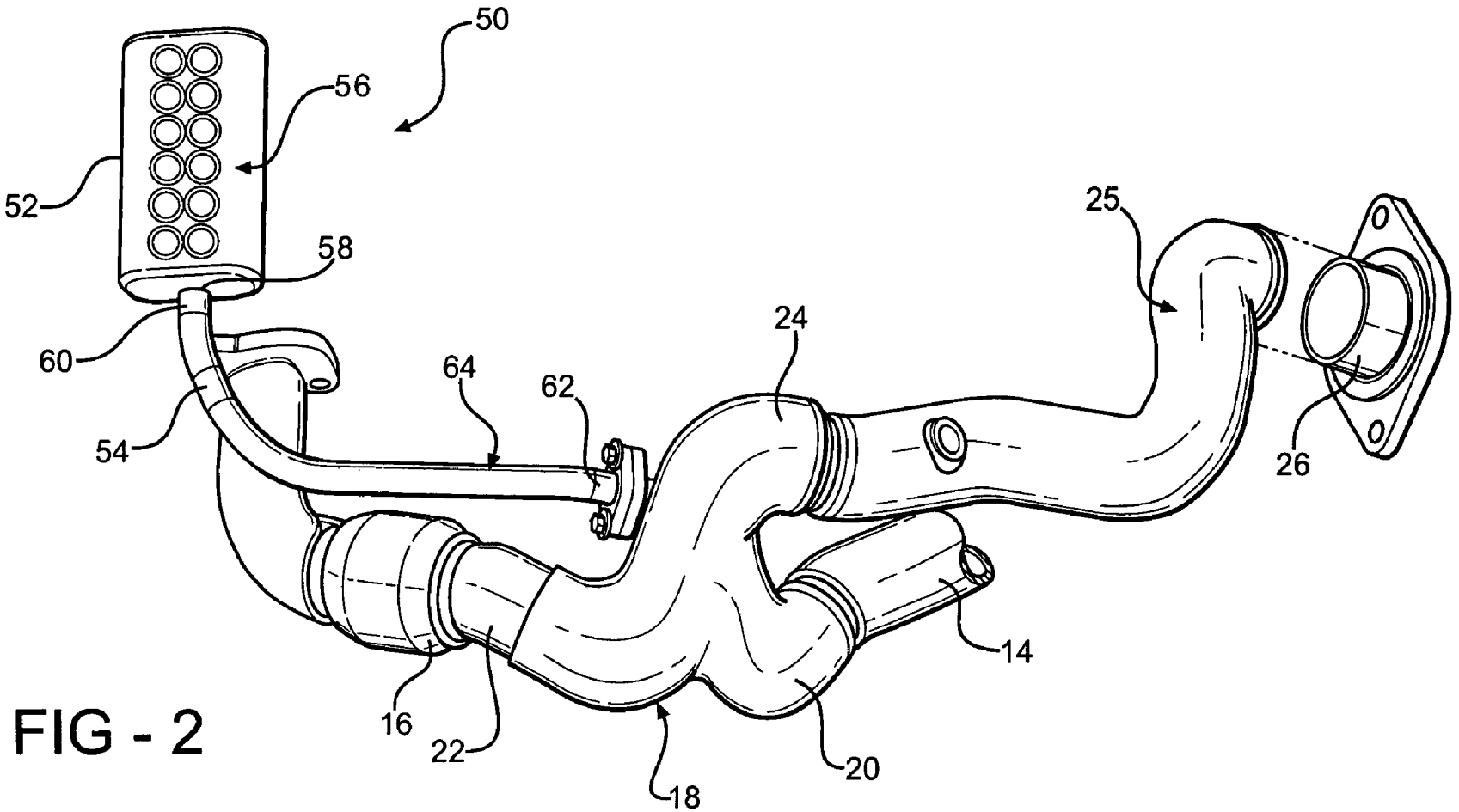
FIG. 2 is a perspective view of a sound dampening assembly in accordance with the present invention shown attached to the exhaust system of FIG. 1.

Referring now to FIG. 2, a sound dampening assembly in accordance with the present invention is indicated generally at 50. The assembly 50 includes a bottle portion 52 and a neck portion 54. The bottle portion 52 is preferably a generally cylindrical, rigid-walled vessel and includes an interior 56 defining a predetermined amount of volume and a single opening 58 to which a first end 60 of the neck portion 54 is attached. The bottle portion 52 is preferably formed of a stainless steel alloy, such as 304L (UNS S30403 per SAE J405) or a similar material having appropriate corrosion resistive properties and suited to withstand the temperatures and pressures associated with the exhaust stream from the engine 12. The neck portion 54 is preferably formed as an elongated tubular member extending from the first end 60 to another opposite second end 62 that is adapted to be attached to the Y-pipe 18. The neck portion 54 includes an interior 64 defining a predetermined amount of volume. The neck portion 54 is preferably formed of a nickel chromium alloy, such as Inconel 625 (nickel chromium alloy 625 per ASTM B 443 Grade 1), or a similar material having appropriate corrosion resistive properties and suited to withstand the temperatures and pressures associated with the exhaust stream from the engine 12. Preferably, the Y-pipe 18 is located in the exhaust system 10 upstream of the resonator 30 and the mufflers 38 and 40 so the sound dampening assembly 50 is as close as possible to the engine 12.

When attached to the bottle portion 52, the interior 64 of the neck portion 54 is in fluid communication with the interior 56 of the bottle portion 52. The volumes of the bottle portion 52 and the neck portion 54, in sum, equal a predetermined volume for the sound dampening assembly 50. The volume of the sound dampening assembly 50, therefore, may be varied by varying the size of bottle portion 52, the diameter and/or the length of the bottle portion 52, the length of the neck portion 54, the diameter of the neck portion 54 or the like. The volume of the sound dampening assembly 50 is equal to an amount of volume required to attenuate vibration at a predetermined frequency in the exhaust system 10.

In operation of the exhaust system 10, the engine 12 is operated, producing a stream of exhaust gas therefrom. As exhaust gas flows from the engine 12 to the atmosphere 42, sound waves or pulsations are produced in the exhaust system 10. The exhaust gas flows from the engine 12 and into the Y-pipe 18. Since the second end 62 of the neck portion 54 is adapted to attach to the Y-pipe 18 at a location of a pressure antinode at a predetermined frequency, at least a portion of the exhaust gas will flow from the Y-pipe 18 through the neck portion 54 and into the bottle portion 52. Since the exhaust gas has no place to flow in the assembly 50, the pressure will increase in the bottle portion 52 until the pressure in the bottle portion 52 is greater than the pressure downstream at a point 25 downstream of the Y-pipe 18 and exhaust gas will flow from the assembly 50 to the point 25 downstream of the Y-pipe 18. After the pressure in the bottle portion 52 decreases, the process is repeated, with the gas trapped in the bottle portion 52 acting like a spring to absorb energy from the exhaust gas stream. The change of direction of the exhaust gas stream from the Y-pipe 18 into the neck portion 54 and the compression of the exhaust gas in the bottle portion 52 contribute to reducing the amount of noise to atmosphere 42 produced by the sound waves in the exhaust gas stream.

As a non-limiting example of frequency dampening for the sound dampening assembly 50, the volume of the assembly 50 for dampening or attenuating the predetermined amount of vibration can be calculated by solving the Equation 1, $$\omega = c\left[\frac{\pi a^2}{(L+2\alpha)V_0}\right]^{1/2},$$

for $V_0$, as described above, although other mathematical formulations may be utilized if so desired, while remaining within the scope of the present invention.

As will be appreciated by those skilled in the art, the length, and/or the diameter, and the resulting volume of the neck portion 52 and bottle portion 54 of the assembly 50 may be varied depending on the needs of the exhaust system 10 to which the assembly 50 is to be attached and the frequency of the vibration to be attenuated while remaining within the scope of the invention.

The sound dampening assembly 50 is used to remove disturbing frequency content from the noise in the Y-pipe 18 prior to the sound reaching the other tuning elements, such as the resonator 30, contained in the exhaust system 10. The sound dampening assembly 50 is located at the beginning, or front, of the exhaust system 10, i.e., closer to the engine 12, and dampens exhaust gas pulsations significantly earlier than traditional tuning elements. By attenuating or dampening the exhaust gases earlier in the exhaust system 10, the assembly 50 advantageously reduces the overall structure borne, pipe radiated and tail pipe noise content of the exhaust system 10. The design of sound dampening assembly 50 according to the present invention does not require the exhaust gases to flow through the assembly 50, which allows the assembly 50 to be more easily packaged in the underhood engine compartment (not shown) and which provides significant flexibility in its design, orientation and location.

While the sound dampening assembly 50 has been described as being adapted to be attached to the Y-pipe 18, those skilled in the art will appreciate that the second end 62 of the neck portion 54 may be attached to any point in the exhaust system 10 where there is a known vibration or frequency that needs to be dampened or attenuated and that more than one sound dampening assembly 50 may be attached to the same point or distinct points in the exhaust system 10 while remaining within the scope of the present invention. The sound dampening assembly 50 functions in a manner similar to a Helmholtz-type exhaust resonator and may be attached to numerous points in the exhaust system 10 including the underhood engine compartment, providing flexibility in locating the assembly 50 and allowing known frequencies to be attenuated without requiring a large redesign of the exhaust system 10.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An automotive exhaust system for an internal combustion engine for routing an exhaust gas stream from the internal combustion engine to atmosphere, the automotive exhaust system comprising:

a first outlet, in fluid communication with the engine, including a first exhaust manifold;

a second outlet, in fluid communication with the engine, including a second exhaust manifold;

a Y-pipe, located downstream from the first exhaust manifold and the second exhaust manifold and having a first inlet in fluid communication with the first exhaust manifold, a second inlet in fluid communication with the second exhaust manifold, and a single outlet located downstream of the first inlet and the second inlet;

at least one of a resonator and a muffler, located downstream of the Y-pipe and in fluid communication with the single outlet of the Y-pipe; and a sound dampening assembly including a bottle portion having a single opening and an interior defining a predetermined bottle volume, and a neck portion having first end attached to the single opening and extending from the bottle portion, the neck portion in fluid communication with the interior of the bottle portion and having a second end, in opposed relation to the first end, attached to and in fluid communication with the Y-pipe, the neck portion having an interior defining a predetermined neck volume, the predetermined bottle volume and the predetermined neck volume sized to attenuate vibration at a predetermined frequency in the Y-pipe.

2. The automotive exhaust system of claim 1 wherein the bottle portion is a rigid walled bottle, the neck portion is an elongated tubular member having a predetermined radius and a predetermined length, and the predetermined bottle volume is determined by the equation $$\omega = c\left[\frac{\pi a^2}{(L+2\alpha)V_0}\right]^{1/2},$$

where ω is the predetermined frequency of the vibration to attenuate, c is the speed of sound, a is the predetermined radius of the neck portion, L is the predetermined length of the neck portion, α is an end correction factor relating to an effective length of the neck portion that accounts for a radiation-mass loading, and $V_0$ is the predetermined bottle volume.

3. An automotive exhaust system for an internal combustion engine for routing an exhaust gas stream from the internal combustion engine to atmosphere, the automotive exhaust system comprising:

a first outlet, in fluid communication with the engine, including a first exhaust manifold;

a second outlet, in fluid communication with the engine, including a second exhaust manifold;

a Y-pipe, located downstream from the first exhaust manifold and the second exhaust manifold and having a first inlet in fluid communication with the first exhaust manifold, a second inlet in fluid communication with the second exhaust manifold, and a single outlet located downstream of the first inlet and the second inlet; and a sound dampening assembly including a bottle portion having a single opening and an interior defining a predetermined bottle volume, and a neck portion having first end attached to the single opening and extending from the bottle portion, the neck portion in fluid communication with the interior of the bottle portion and having a second end, in opposed relation to the first end, attached to and in fluid communication with the Y-pipe, the neck portion having an interior defining a predetermined neck volume, the predetermined bottle volume and the predetermined neck volume sized to attenuate vibration at a predetermined frequency in the Y-pipe; and wherein the bottle portion is a rigid walled bottle, the neck portion is an elongated tubular member having a predetermined radius and a predetermined length, and the predetermined bottle volume is determined by the equation $$\omega = c\left[\frac{\pi a^2}{(L+2\alpha)V_0}\right]^{1/2},$$

where ω is the predetermined frequency of the vibration to attenuate, c is the speed of sound, a is the predetermined radius of the neck portion, L is the predetermined length of the neck portion, α is an end correction factor relating to an effective length of the neck portion that accounts for a radiation-mass loading, and $V_0$ is the predetermined bottle volume.

* * * * *